US010867473B2

(12) United States Patent
Greenberg Castro

(10) Patent No.: US 10,867,473 B2
(45) Date of Patent: Dec. 15, 2020

(54) ONLINE GAMING SYSTEM PROVIDING DOUBLE WAGER WITH COMPENSATION PAYOUTS FOR LOSSES

(71) Applicant: Playtika Ltd., Tel Aviv (IL)

(72) Inventor: Erez Greenberg Castro, Hertzliya (IL)

(73) Assignee: Playtika Ltd., Herzliya Pituach (IL)

( * ) Notice: Subject to any disclaimer, the term of this patent is extended or adjusted under 35 U.S.C. 154(b) by 229 days.

(21) Appl. No.: 15/336,753

(22) Filed: Oct. 27, 2016

(65) Prior Publication Data

US 2017/0124802 A1 May 4, 2017

Related U.S. Application Data

(60) Provisional application No. 62/249,125, filed on Oct. 30, 2015.

(51) Int. Cl.
*A63F 9/24* (2006.01)
*G07F 17/32* (2006.01)

(52) U.S. Cl.
CPC ..... *G07F 17/3244* (2013.01); *G07F 17/3225* (2013.01); *G07F 17/3255* (2013.01); *G07F 17/3267* (2013.01)

(58) Field of Classification Search
CPC ..... G07F 17/3244; G07F 17/3267; G07F 17/3225; G07F 17/3255
See application file for complete search history.

(56) References Cited

U.S. PATENT DOCUMENTS 6,033,307 A * 3/2000 Vancura ..... G07F 17/32 273/138.2
8,517,384 B2 8/2013 Carbonaro
8,845,417 B1 9/2014 Englman et al.
2003/0013516 A1* 1/2003 Walker ..... G07F 17/32 463/25
2003/0022713 A1* 1/2003 Jasper ..... G07F 17/3267 463/20
2003/0087687 A1* 5/2003 Locke ..... G07F 17/3211 463/20
2003/0224848 A1* 12/2003 Baerlocher ..... G07F 17/32 463/16
2004/0204228 A1* 10/2004 Walker ..... G07F 17/3244 463/20

(Continued)

OTHER PUBLICATIONS

International Application No. PCT/IB2016/001645, Notification of Transmittal of the International Search Report and the Written Opinion of the International Searching Authority, dated Mar. 7, 2017, 8 pages.

*Primary Examiner* — Dmitry Suhol
*Assistant Examiner* — Carl V Larsen
(74) *Attorney, Agent, or Firm* — Fish & Richardson P.C.

(57) ABSTRACT

An online gaming system provides a double wager with various compensation payouts for a player's win in a primary game. The double wager is selectively offered to the player based on eligibility requirements related to a marketing segment associated with the player. The double wager is a fair (or better than fair) bet for the player, but in cases where the player loses the double wager, a compensation payout is offered. The particular compensation payout offered, and the parameters of the compensation payout, are determined based on a number of factors, again based on the player's segment as well as a random selection mechanism.

10 Claims, 9 Drawing Sheets

(56) References Cited

U.S. PATENT DOCUMENTS

| | | | | |
|---|---|---|---|---|
| 2006/0160595 | A1* | 7/2006 | Gerson | G07F 17/32 463/16 |
| 2008/0153570 | A1* | 6/2008 | Esses | G07F 17/3244 463/20 |
| 2009/0270173 | A1* | 10/2009 | Christensen | G07F 17/32 463/42 |
| 2011/0105216 | A1* | 5/2011 | Cohen | G07F 17/3244 463/20 |
| 2011/0263312 | A1 | 10/2011 | De Waal et al. | |
| 2013/0143645 | A1* | 6/2013 | Schaefer | G07F 17/3267 463/25 |
| 2017/0053474 | A1* | 2/2017 | Harris | G07F 17/329 |

* cited by examiner

ONLINE GAMING SYSTEM PROVIDING DOUBLE WAGER WITH COMPENSATION PAYOUTS FOR LOSSES

CROSS-REFERENCE TO RELATED APPLICATION

This application claims the benefit of U.S. Provisional Application No. 62/249,125, filed Oct. 30, 2015, which is incorporated herein by reference in its entirety.

BACKGROUND

Field of Invention

The described embodiments relate generally to online gaming for casino type games, and more particularly to electronic data processing system that provide a monetary-type accounting for the purpose of wagering and determining an award or payout amount.

Description of Related Art

Online gaming using casino type games provides players with the opportunity to experience the excitement of casino gaming without the necessity of travelling to a physical casino. In most online casino gaming, the player pays for an allotment of credits using real money, which credits are then used for making wagers and receiving payouts. The offered games are variations of casino games, such as slots, poker, blackjack, roulette, crap, baccarat, and so forth. Conventional online gaming typically offers wagers, payouts table and bonus tables that generally correspond to the payouts and bonus structures available in physical casinos. One wager that is sometimes offered to a player occurs when a player wins a gaming round in a primary game (e.g. slot game, poker game, blackjack, roulette game) and then is offered a "double or nothing" wager, whereby they can wager the entire amount of their payout from the primary game on a fair bet that has a 50% probability of winning. An example of a fair bet with a 50% probability of winning the selection of heads or tails on a coin toss; another example is the selection of a suit color, red or black, for a randomly selected card from a standard deck of playing cards. If the player wins the bet, they receive a payment equal to double the prior payout; otherwise they lose the entire wager. Once this bet concluded, the player is returned to the underlying game. Where the double or nothing wager is offered at all, it is typically offered to all players who win primary gaming round, without regards to any other criteria. Thus, conventional systems do not address the problem of selectively offering the double or nothing wager based on programmatically available information about the player.

DESCRIPTION OF THE EMBODIMENTS

Figure 1:
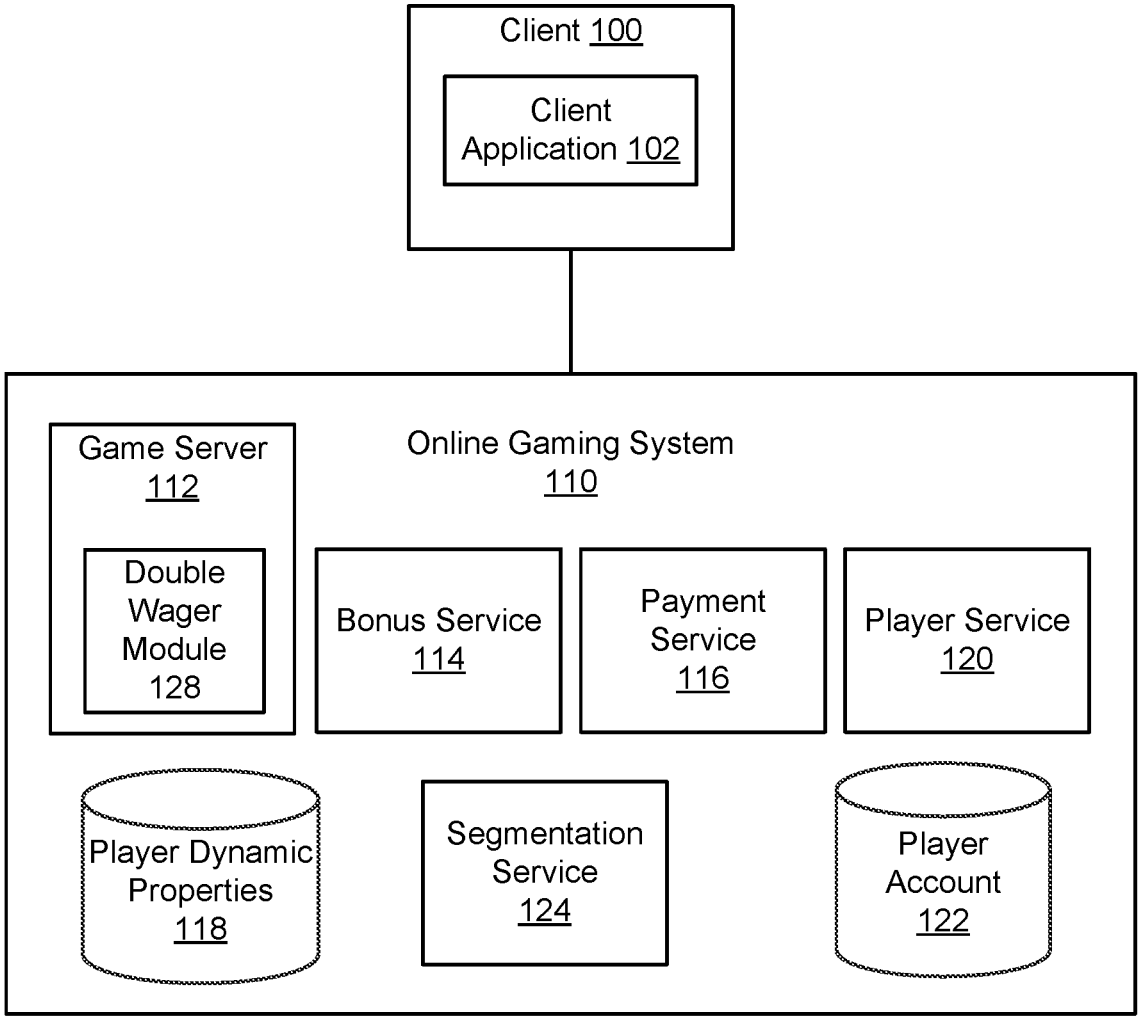
FIG. 1 is a block diagram of the overall architecture of one embodiment.

An online casino gaming system executes a primary game that a player can access from a client device, and in which a player makes a wager and can win or lose the primary wager. When the player wins the primary wager, the gaming system enables an opportunity for the player to double the amount of the winnings; the opportunity for the double wager is selectively presented to only certain players based on eligibility requirements related to a player's segment. If the player makes the double wager, and loses, they receive one of plurality of different compensation payouts, rather than simply having to accept a complete loss of their wager. The values for the compensation payouts, such as the amount of the payouts, prices, and other factors are programmatically controlled by a combination of a player's segment and random selection algorithm. A player's segment is based on their historical levels of investment and game play, as determined by a segmentation service of the online gaming system using player account data.

In one embodiment, the online gaming system determines after a player wins a round in a primary game whether a player is eligible to receive a double wager based on eligibility requirements. The eligibility requirements are associated with a plurality of player segments that are used by a segmentation service to segment a population of players into different categories based on their gaming behavior. The online gaming system stores a database of player account information. Each player is associated with a segment. Generally, a segment is characterized by a tier and a level, and a set of additional segmentation attributes. The tier indicates an overall measure of player value to the gaming establishment operating the online gaming system, and the level indicates further measure of value within a segment. Each segment is associated with an indicator of whether the double wager is available for the segment. A segment may be further characterized by whether the player is a paying player (i.e., the player pays actual money for gaming credits) is a non-paying player (i.e., the player is playing with free credits), the minimum bet amount per game, a win amount per game, a type of win for the game, winning triggers, maximum and minimum value for money thresholds, a type of win, and an indicator of whether the segment is enabled to override the other eligibility requirements and either enable or disable double wager. Thus, each time a player wins a primary gaming round, the online gaming system evaluates the player against the attributes for the player's segment to determine if the player is eligible for the double wager. The evaluation may be performed by querying a database or a lookup table using a player's ID to obtain a segment assigned to the player, as stored in a player account profile in the player account database.

The online gaming system supports a double wager with a plurality of different types of compensation payouts, which are selectively and programmatically parameterized based on the player's segment. Once the online gaming system determines that the player is eligible for the double wager, the system automatically selects a type of compensation payout to offer with the double wager. The system further determines the particular parameters for the selected compensation payout of the double wager to be offered to the player based on the player's segment. The compensation payouts for players in different segments have different parameters which control the probabilities of payouts, amounts of payouts, pricing factors and so forth. Using player segmentation to control the parameterization of the compensation payouts provides for very fine grained control of the double wager, as compared to the conventional approach that offers all players the same double or nothing wager.

The various types of compensation payouts that may be automatically selected by the online gaming system to present to a player include:

Free Time Period for Double Experience Points: A free amount of gaming time during which experience points are doubled. This type of compensation payout provides the player with a parameterized amount of time (in hours or minutes) in which experience points earned by the player in the underlying gaming system and games are doubled. Generally, the online gaming system provides each player with experience points that depend on the amount of time the player has spent playing games. These points are separate from and in addition to any credits earned from winning games. Experience points may be used to unlock games or levels of games, different bonus games, paytables, or others features of the online gaming system. Generally, players earn experience points at a predetermined rate in terms of a number of experience points per unit time of gaming. Accordingly, this compensation payout provides the player with a selected amount of time during which they earn experience points at twice the predetermined rate. The amount of time (in terms of number of minutes or hours) is selected from a schedule of amounts, in which there is probability distribution defining the probability of a player receiving each amount in the schedule, the distribution based on the player's segment. For example, the amount of time may be 10 minutes, 20 minutes, 30 minutes, 1 hour, 2 hours, 4 hours, 6 hours, 12 hours, and 24 hours. The probability distribution is parameterized based on the player's segment. Once the player's account is configured with the specified amount of time, game play continues with the primary game, and the double experience point period begins.

Returned Percentage of Credits of Original Win: This compensation payout provides a selected percentage of the credits wagered and lost in the double wager, based on a schedule of percentages. For example, the player may receive 10%, 20%, 30%, 40%, 50%, 75%, 100%, 200%, or 400% of the credits wagered. Note that this compensation payout may in fact be greater than the original wager or even the double payout itself (e.g., 400%), thus providing an instance of "winning for losing." Again, a probability distribution associated with the schedule of percentages, with the distribution based on the player's segment. Once the player receives the returned percentage in their account, game play continues with the primary game.

Pay to Receive Original Win: This compensation payout allows the player to pay a calculated amount of credits to receive back the original number credits wagered and lost in the double wager. For example, the player may be preferred an offer to pay 2,000 credits (in terms of a real money equivalent, e.g., 100 credits per $1, thus $20) to receive back their original 100,000 credit wager. The amount to be paid is based on the player's segment. Once the amount is paid, the player receives their original wager back and game play continues with the primary game.

Pay to Undo Last Round: This compensation payout allows the player to pay a calculated amount of credits to undo the results of the double wager round, and have the choice to enter the double wager again. For example, the player maybe offered to pay 2,000 credits (in terms of a real money equivalent, e.g., 100 credits per $1, thus $20) to receive back their original wager, and then have the opportunity to enter into a new double wager, or exit the double wager and continue playing the primary game.

Free Locking of Gaming Payouts: Normally, to enable access to particular features of a primary game, such as more advanced levels, different pay tables or wagering payouts, a player has to either pay credits to unlock such features, or have sufficient experience points. In this compensation payout, selected feature of a primary game are automatically unlocked and thus enabled for the player without the player having to make any payment in terms of credits or experience points. Once the player's account is configured to indicate the particular features of a primary game that are unlocked, game play continues with the primary game.

The online gaming system selects from different compensation payouts using a probability distribution based on the number of different payout available, or alternatively based on the player's segment. In one embodiment, an equal probability distribution is used, so there is an equal chance for each payout to be selected. For example, in an embodiment using the five compensation payouts above, each is assigned a 20% probability of selection. In an alternative embodiment, the player's segment and parameters therein may be used, providing a non-equal distribution of probabilities.

FIG. 1 illustrates a block diagram of an online gaming system in accordance with one embodiment. The online casino gaming system 110 communicates over network (not shown) with client device 100. Only a single instance of a client device 100 is shown here, but it is understood that in practice the online casino gaming system 110 is in communications with thousands, and potentially millions of client devices 110 at any given time. The network is a public wide area network supporting Internet protocols. The client device 100 executes a client application 102 of the online casino gaming system 110, which may be either a native client application or an application running in a browser via client side scripting languages.

The online casino gaming system 110 include the following modules: a game server 112, a bonus service 114, a payment service 116, a player dynamic properties database 118, a player service 120, a player account database 122, and a segmentation service 124. These modules are not native components of the underlying computer or operating systems, and provide specific functionality beyond the generic functions of such computers, as further described below.

The game server 112 comprises programmed logic to provide one or more casino games to the client device 100, and is one means for performing this overall function, and the further functions described herein. The game server 112 provides a player interface for each primary game, including generation of graphic images of game objects, such as cards, dice, slot wheels, and the like. Primary games include poker games, slot games, roulette games, baccarat games, blackjack games, pai gow games, and the like. The game server 112 further provides the underlying game logic which operates a primary game according to programmed rules of play, and in accordance with such game logic, generates the corresponding displays, prompts and other interactive elements for the player to operate to play the game.

The game server 112 is further programmed with a double wager module 128 to provide the double wager with compensation payouts as described herein, and is one means for performing this function. In particular, the double wager module 128 comprises program data and logic for dynamically determining and selecting which compensation payouts are available to a player at any given time, based on the player's segment, and game state.

The bonus service 114 comprises programmed logic to provide bonus gaming rounds within the context of a primary game in response to game events such as a player winning a particular gaming round or acquiring specific objects, credits experience points, and is one means for performing these functions.

The payment service 116 comprises programmed logic to receive payments of credits from the player's account in the player account database 122 and make deposits of credits to the player's account. In particular, the payments service is configured to receive payments for selection of a compensation payout from a player, and deposit where appropriate credits received via the compensation payout.

The player dynamic properties database 118 comprises a database (e.g., a relational database) in which the dynamic properties of a player are maintained and updated by the player service 120, which is one means for performing this function. The dynamic properties of a player are those that change during game play, such properties pertaining to the current gaming session (e.g., client IP address, computer ID, session keys, game identifiers) as well as player credit balance within a game, player experience point balances and counts, current game state (e.g., cards selected, turn information, selected game theme, and the like).

The player account database 122 stores master data for the player in a database table, such as player account information including player name, player ID, password, credit card or other payment information, addresses and biographical information (e.g., date of birth). The player account database 122 further stores segment information defining the player's segment for use by the game server 112 in selecting compensation payouts, where the segment is indicated by a segment ID. The player account database 122 can be queried using the player ID to return any attributes of the player account information, including the player's segment information.

The segmentation service 124 comprises programmed logic to create and manage player segments, and to handle queries from the game server 112 and the double wager module 128 regarding player segment information and parameters, and is one means for performing this function. As described above, a number of different compensation payouts are made available to the player based on various eligibility criteria associated with player segmentation. Player segments are sets of programmable criteria that allow the online casino gaming system 110 to divide the player population into small subpopulations, and then provide customized gaming experiences using double wagers for each such subpopulation, based on programmed logic that makes use of the segment information. Segments further provide a separate way of providing customized experiences that are controlled by the occurrences of events in addition to any specific player attributes, so that player may have a different experience based on which events trigger which features or functions of the online casino gaming system 110 based on the player's segment. Segments can be defined at the most granular level and can also be defined as combination of several segments. The segmentation service 124 is used to define the segments and store them in memory available for querying and evaluation.

The double wager with multiple different compensation payouts improves the overall gaming experience for the player by providing valuable compensation to the player in the event that the player loses the double wager, as in conventional systems. In some instances, the value of the compensation is greater than either the amount the player wagered, or even the amount that the player could have won in the double wager. This increases the player's satisfaction and sense of excitement in playing. In addition, offering the player options to pay for certain ones of the compensation payouts increases revenue to the casino.

Method of Operation

Figure 2A:
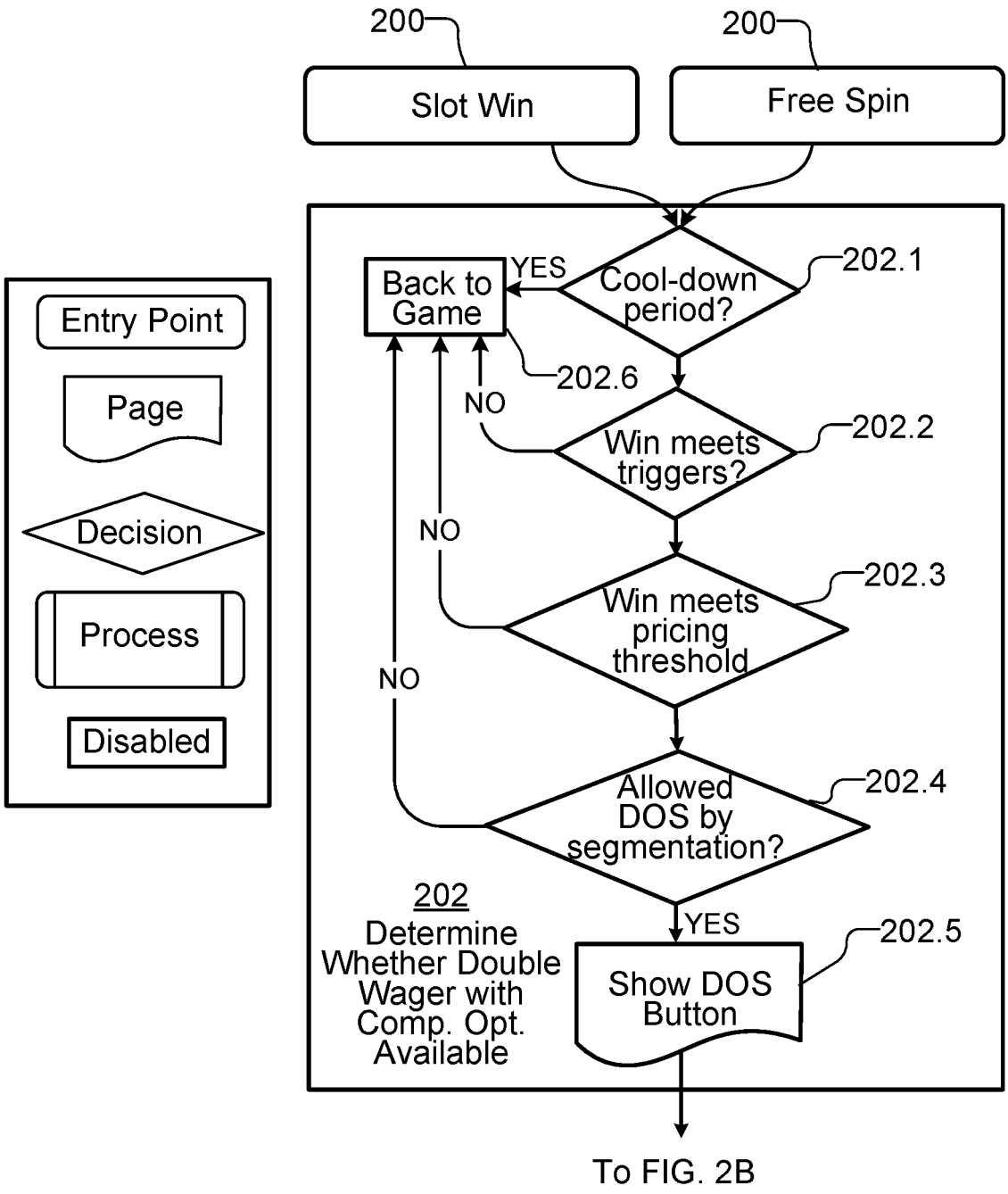
FIGS. 2A-2B are a flow diagram of the overall method of operation of the game server.
Figure 2B:
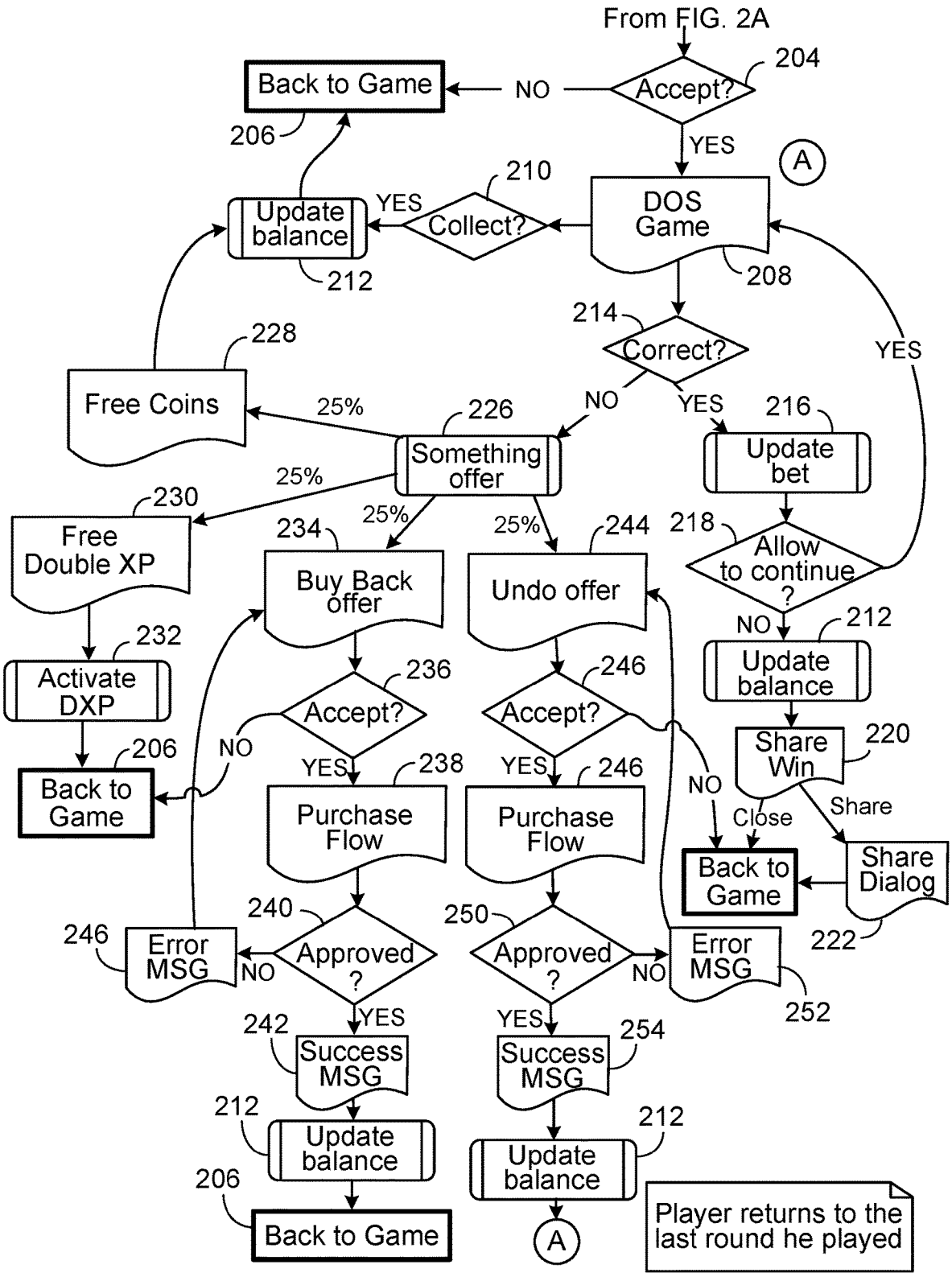

Referring now to FIGS. 2A-2B, there is shown a flowchart for one embodiment of an algorithm as may be implemented by a gaming system 110 executing the double wager module 128. The entry point to the method occurs when a player wins 200 a round in the primary game, for example via winning combination or a free spin in a slot machine game; other types of wins, such as a winning hand in a poker game, a blackjack win in a blackjack game, may be entry points as well. The game server 112 invokes the double wager module 128 which then determines 202 whether the player is eligible for a double wager with a compensation payout. As the availability of the double wager with compensation payouts for a particular player depends on multiple different segment parameters, the double wager module 128 is configured to query the player account database 122 to determine the segment assigned to the player, using the player's ID. The double wager module 128 may query each time a determination is to be made or may query at the start of a gaming session and cache the results in memory. Given the segment ID, the double wager module 128 can query the segmentation service 124 with the segment ID, which returns an indication of whether the double wager with compensation payouts is available; where the compensation payouts are available with differing probabilities, the segmentation service 124 also returns an indication of the appropriate probability distribution or schedule for selecting the compensation payout to offer the player.

In one embodiment, the segments are associated with the following parameters, each of which can be used to independently define a segment:

- Tier: Tiers represent an overall value of the player to the system operation based on loyalty of the player. Each player is assigned a tier, and player may change tiers over time. Different tiers lead to different values for money win results based on the player's bet behavior. These different values for money results lead to different expected frequencies of the availability of the compensation payouts per tier.
- Levels: Levels and level ranges provide different initial bet values, which result in different win amounts. Each player is assigned a level or level range. The different win amounts result in different value for money parameters, which again lead to different expected frequencies for the availability of the compensation payouts per level.
- Paying/Non-paying: This parameter identifies whether a player is a paying player (in that they pay for gaming credits to play the available primary games) or a non-paying player (they use free or promotional credits to play). This parameter also allows for using different expected frequencies for the availability of the compensatory payouts. In one embodiment, non-paying players are assigned high availability frequencies for compensation payouts than paying customers.
- Min/Max Value for Money: the minimum value for money segment parameter ensures that the compensation payouts are only offered with a predetermined minimum transaction amount to be met by the player in real dollar terms, for example, purchasing a minimum amount of credits during one of the payouts. The maximum value for money segment parameter ensures that the compensation payout is only offered with the maximum transaction amount is not restricted by other controls or factors, such as daily transaction limits. For example, the minimum and maximum amounts may be set for the amount of the win in the primary game to qualify for the double wager. Each player is assigned a minimum and maximum segment parameter (Yes or No) based on a combination of the player's segments in Tiers, Levels, and Paying/Non-paying. If the setting is No, then the double wager is offered to a player in this segment so long as the other segmentation parameters are satisfied. If the setting is Yes, the minimum and maximum values are obtained, as further explained below with respect to Table 2.

Cool down: This segment parameter allows for overriding of all other segment rules to control the availability of the compensation payouts so that they are not offered too frequently in any given time period, or too many times in a row.

Win Type: this segment parameter defines the specific types of winning events in the primary game that can trigger the offering of the compensation payouts to the player. This allows the online casino gaming system 110 to enable the double wager with compensation payouts in response to some types of wins (e.g., regular spin, free spin, bonus spin, natural blackjack) but not others (e.g., player winning a blackjack round from a dealer bust), as well as bet and win amounts.

Win Trigger: This segment parameter indicates whether additional thresholds must be met based on the amount of the win in order for the double wager to be offered. If Win Trigger is "Yes" then the additional threshold values are determined, as further explained below with respect to Table 3.

Platform: this segment parameter is based on the software and/or hardware platform of the client device. The platform types include web-based client, Android™ client, or iOS™ client.

Table 1 provides an example of the various segments that can be generated by the segmentation service 123 using these segment parameters. Each row represents a particular segment (with segment ID), and the parameter values in each column. The final column "Comp. Opt. Available?" indicates whether the double wager with compensation payout is available to player in this segment. The segment parameters, such as those, defined in Table 1 may be stored in a table structure or similar data structure by the segmentation service 124, for subsequent querying and lookup.

TABLE 1

Example Segment Table

| Segment ID | Tier | Level | Paying? | Bet Amount | Win Amount | Win Type | Win Trigger? (Table 3) | Min/Max V. for. M? (Table 2) | Cool-down? | Comp. Opt. Available? |
|---|---|---|---|---|---|---|---|---|---|---|
| 1 | Bronze | 7 | No | 1,500 | 2,500 | Regular Spin | No | Yes | No | No |
| 2 | Silver | 12 | No | 5,000 | 8,000 | Free Spins | Yes | Yes | No | Yes |
| 3 | Platinum | 35 | Yes | 15,000 | 45,000 | Regular Spin | Yes | Yes | No | Yes |
| 4 | Diamond | 35 | No | 20,000 | 60,000 | Regular Spin | Yes | Yes | No | Yes |
| 5 | Royal Diamond | 650 | Yes | 10,000,000 | 25,000,000 | Free Spins | Yes | No | No | No |
| 6 | Black Diamond | 950 | Yes | 25,000,000 | 500,000,000 | Free Spins | Yes | Yes | No | Yes |
| 7 | Bronze | 7 | No | 1,500 | 6,500 | Regular Spin | Yes | Yes | Yes | No |
| 8 | Silver | 12 | No | 5,000 | 8,000 | Free Spins | Yes | Yes | Yes | No |
| 9 | Platinum | 35 | Yes | 15,000 | 45,000 | Regular Spin | Yes | Yes | Yes | No |
| 10 | Diamond | 35 | No | 20,000 | 60,000 | Regular Spin | Yes | Yes | Yes | No |
| 11 | Royal Diamond | 35 | Yes | 50,000 | 300,000 | Regular Spin | Yes | Yes | No | Yes |
| 12 | Bronze | 35 | Yes | 7,500 | 50,000 | Free Spins | Yes | Yes | No | Yes |
| 13 | Silver | 35 | No | 10,000 | 50,000 | Regular Spin | Yes | Yes | No | Yes |
| 14 | Black Diamond | 35 | No | 10,000 | 50,000 | Regular Spin | Yes | Yes | No | Yes |
| 15 | Gold | 35 | No | 10,000 | 50,000 | Regular Spin | Yes | Yes | No | Yes |
| 16 | Gold | 35 | Yes | 5,000 | 10,000 | Regular Spin | No | No | Yes | No |
| 17 | Gold | 35 | No | 5,000 | 10,000 | Regular Spin | No | No | Yes | No |
| 18 | Silver | 7 | Yes | 2,500 | 10,000 | Regular Spin | Yes | Yes | No | Yes |
| 19 | Gold | 7 | Yes | 6,000 | 24,000 | Regular Spin | Yes | Yes | No | Yes |
| 20 | Diamond | 7 | Yes | 20,000 | 80,000 | Regular Spin | Yes | Yes | No | Yes |

The double wager module 128 queries the segmentation service 123 with the player's segment ID, and values of the player's current game, including bet and winning amount to determine 202 whether the compensation payouts are available, using the stored segment parameters.

In one embodiment, the determination 202 comprises a series of conditional evaluations of the segment parameters from the player's segment as provided by the compensation service 124. In this embodiment, the double wager module 128 first determines 202.1 whether a cool down period is in effect; if so then the double wager module 128 returns 206 to a main display screen for the primary game. Otherwise, the double wager module 128 continues.

The double wager module 128 also determines 202.2 whether or not the win type from the primary game satisfies the win type triggers defined in the segment. As explained above, each segment can have specific win triggers. For example, the following triggers to be related to the win type:

1. For regular spins— a. The ratio (Total Win/Total Bet) is bigger than or equal to 3.

i. Example—player bets a total of 100,000 coins and wins 300,000 coins—player may be eligible to get double wager, depending on the other attributes ii. Example—player bets a total of 100,000 coins and wins 299,999 coins—player will not be eligible to get the double wager.

b. the ratio (Total Win/Total Bet) is be below 12 i. Example—player bets a total of 100,000 coins and wins 1,199,999 coins—player may be eligible to get the double wager, ii. Example—player bets a total of 100,000 coins and wins 1,200,000 coins—player will not be eligible to get double wager.

2. For free spin rounds—player may be eligible to get the double wager on any win.

3. For bonus games—player will be eligible to get the double wager on any win.

The limitations above can be configured differently for each player based on the player's tier and level. This ability offers an improvement in the configurability of the double wager offer, as compared to prior approaches, for example, offering the double wager to all players without regard to any criteria such as the type of win and the ratio of the win to the wager. Accordingly, the double wager module 128 can pass into the segmentation service 123 the type of win (regular, free spin, bonus spin, etc.), the current bet and win amount, which the segmentation service 123 evaluates whether the win type triggers have been met. If not, then the double wager module 128 returns to the primary game.

If so, the double wager module 128 determines 202.3 whether the win amount from the primary game meets the minimum and maximum value thresholds. This can be done by having the segmentation service 123 programmatically compare the win amount with a stored table specifying the various thresholds with respect to various segmentation parameters for tier, level, whether the player is paying or non-paying, and the type of platform of the client device, as shown in Table 2:

TABLE 2

| Tier | Level Range | Paying/Non-paying | Platform | Min Coins | Max Coins |
|---|---|---|---|---|---|
| Bronze | 1-99 | Non-Paying | Web | 2,000 | 849,999,999 |
| Silver | 1-99 | Non-Paying | Web | 5,000 | 999,999,999 |
| Gold | 1-99 | Non-Paying | Web | 15,000 | 1,199,999,999 |
| Platinum | 1-99 | Non-Paying | Web | 30,000 | 1,699,999,999 |
| Diamond | 1-99 | Non-Paying | Web | 40,000 | 2,099,999,999 |
| Royal Diamond | 1-99 | Non-Paying | Web | 40,000 | 2,499,999,999 |
| Bronze | 1-99 | Paying | Web | 5,000 | 239,999,999 |
| Silver | 1-99 | Paying | Web | 10,000 | 1,099,999,999 |
| Gold | 1-99 | Paying | Web | 15,000 | 359,999,999 |
| Platinum | 1-99 | Paying | Web | 30,000 | 449,999,999 |
| Diamond | 1-99 | Paying | Web | 40,000 | 599,999,999 |
| Royal Diamond | 1-99 | Paying | Web | 40,000 | 699,999,999 |
| Diamond | 300-399 | Non-Paying | Web | 500,000 | 15,999,999,999 |
| Diamond | 300-399 | Non-Paying | Android | 500,000 | 1,499,999,999 |
| Diamond | 300-399 | Non-Paying | iOS | 500,000 | 399,999,999 |
| Diamond | 300-399 | Paying | Web | 7,500,000 | 4,499,999,999 |
| Royal Diamond | 300-399 | Paying | Web | 37,000,000 | 5,499,999,999 |
| Royal Diamond | 500-999 | Non-Paying | Web | 40,000 | 6,999,999,999 |
| Black Diamond | 500-999 | Paying | Web | 80,000,000 | 2,999,999,999 |

Table 2 shows that different maximum and minimum win amounts in the primary game are used to determine whether the double wager is available based on the player's tier and paying/non-paying status and the platform. If the player's win amount is between the two thresholds, the double wager module 128 continues; if not the double wager module 128 returns to the primary game.

At 202.4, the double wager module 128 determines whether the double wager is allowed by the player's segment based on the "Comp. Opt. Available?" value in the corresponding row for the player's segment in Table 1 or similar segment parameter table. If so, the double wager module 128 displays 202.5 on the display screen of the client device a button indicating the availability of the double wager payout. (The various above conditionals can be executed in a different order).

The double wager module 128 receives an input from the client device to the gaming system, and determines 204 from the input whether the player has accepted the double wager; if not the double wager module 128 returns 206 to the main screen of the primary game. If the player accepts 204 the double wager, the double wager module 128 displays 208 the page for the double wager game.

Figure 3:
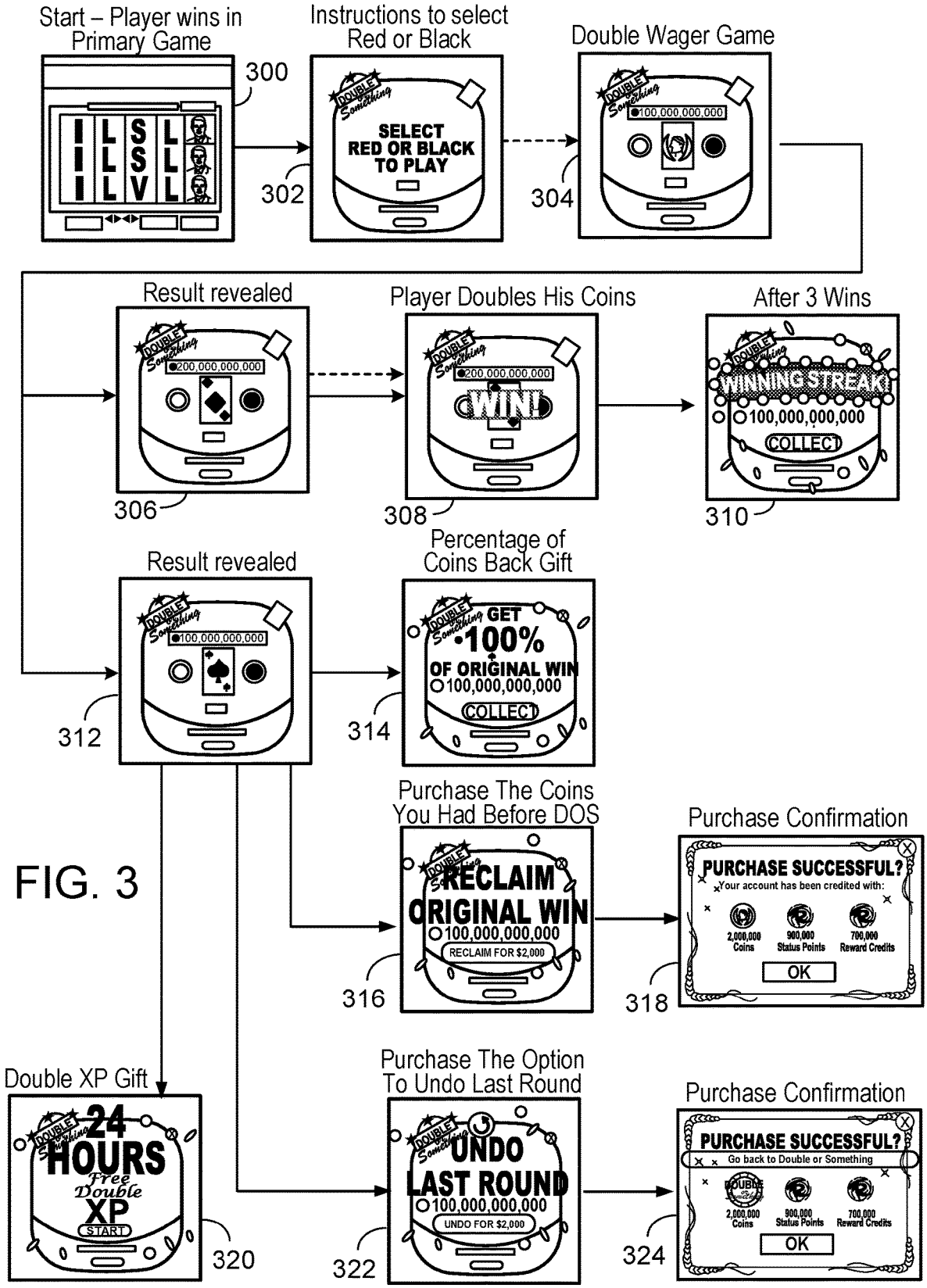
FIG. 3 is a flow diagram of the user interface presented by the game server.

FIG. 3 illustrates a sequence of user interface displays of the client device in regards to these operations. At 300, the user interface display is as it appears on the client device after the double wager module 128 has determined that the player has won the primary gaming round, and has determined 202 that the player is eligible for a double wager, and thus displays the double wager button (here labeled "Double or Something"). Responsive to the player selecting the double wager button, the double wager module 128 displays a screen 302 with the instructions for interacting with the client device to undertake the double wager with two possible outcomes with equal probability (hence, a fair bet), followed by screen 304 which presents the double wager via graphical icons representing the two possible outcomes from which the player is to select. If the user does not select the double wager button, the double wager module 128 determines 210 whether the player has indicated to collect the winnings from the primary game, and if so, calls the payment service 116 to update 212 the player's balance in the dynamic properties database.

Referring again to screen 304, the player provides an input of a selection of a game result (red or black) by selecting (e.g., clicking, touching) the graphic icons for the payout (e.g., red or black chip icon). The double wager module 128 determines 214 whether the player has chosen correctly. As mentioned, the double wager is a fair bet with equal probabilities of outcomes (red or black). In one embodiment, to determine if the player chose correctly, the double wager module 128 generates a random number, and compares the random number with a defined schedule of ranges that map the number on the outcome, e.g., (0.0-0.50) to "red" and (0.50-0.1.] to "black." Alternatively, the double wager module 128 may iteratively traverse a predetermined list of random outcomes ("red," "black"), retrieving the next result on the list. In another embodiment, the double wager is not a fair bet, but rather the odds are structured in the player's favor, for example a 55%/45% distribution. This provides a further incentive for the player to enter into the double wager.

If the player's selection outcome was correct (i.e., the outcome matched the random result), then player's bet is doubled and the double wager module 128 calls 216 the payment service to update the value of the bet. Referring to FIG. 3 again, screen 306 illustrates an example where the player's selection was correct by matching the player selected red chip with randomly selected red card. Screen 308 illustrates that the player is notified of having won the double wager.

The double wager module 128 next determines 218 whether the player is allowed to continue with a further round of the double wager. The determination is based on a limit for the number of rounds, such as a three round maximum, which if the player won the double wager three times would result in an eight fold increase in the original wager. The maximum number of rounds may be determined based on the real dollar amount that the player has won, as well as the platform type that the player is using. For example, player's using a web client may have a limit based on a real dollar maximum of $1,000, whereas players using a mobile device platform such as Android or iOS may have a lower limit, such as $200 as a security provision to reduce the risk of fraud. According, in this embodiment, the double wager module 128 determines from client device its platform type, such from an application ID from the client device application.

If the player is allowed to continue, the double wager module 128 returns to the presentation 208 of the double wager game. If the player is not allowed to continue, the double wager module 128 presents a screen such as screen 310, indicating that the player is to collect the total winnings. Then the double wager module 128 calls 212 the payment service to update the player's balance with the value of their winnings, passing in the player ID and the amount won; the payment service updates the player's balance in the player dynamic properties database 118 with the amount won. The player may be presented a page 220 to share information about the player's double wager win with others, followed by a dialog box 222 for input text information. Or the player may choose not to share, in which case double wager module 128 returns to the main screen of the primary game.

Referring back to step 214, if the player choose incorrectly in the double wager—that is the player lost—the double wager module 128 displays a screen, such as screen 312 showing that the player has lost the double wager. The double wager module 128 then makes a determination 226 of which compensation payouts to offer to the player. The following Table 3 provides a summary of the compensation payouts that can be offered to a player. The compensation payouts such as in Table 3 are stored in table or similar data structure by the double wager module 128. One of these payouts is selected by the double wager module 128 in determination process 226.

TABLE 3

| FIG. 2 Block ID | 230 | 228 | 234 | 244 | Not Shown |
|---|---|---|---|---|---|
| Name | Free <X> Minutes/Hours Double Experience Points | Free <% X> Coins of Original Win | Pay to Get Back Original Win | Pay to Undo Last Round | Free "Pay to Unlock" Feature |
| Description | Player receives a compensation payout equal to an amount of free time during which double experience points are earned. | Player receives as compensation a certain percentage out of the amount of credits lost in the double wager | Pay to get back the original amount of credits lost in the double wager. | Pay to get back into the game with ability to continue playing or cash out. | Get as compensation access to a feature that is "Pay to Unlock" for FREE |
| Possible Values | 1. 10 Minutes<br>2. 20 Minutes<br>3. 30 Minutes<br>4. 1 Hour<br>5. 2 Hours<br>6. 4 Hours | 1. 10%<br>2. 20%<br>3. 30%<br>4. 40%<br>5. 50%<br>6. 75% | Price is based on the player's Value for Money | Price is based on the player's Value for Money | Any programmatically controllable feature of primary game or gaming system |

TABLE 3-continued

| FIG. 2 Block ID | 230 | 228 | 234 | 244 | Not Shown |
|---|---|---|---|---|---|
| | 7. 6 Hours<br>8. 12 Hours<br>9. 24 Hours | 7. 100%<br>8. 200%<br>9. 400% | | | |

In determination process 226, the compensation payouts may be available with an equal probability or with different probabilities. The segmentation service 124 may store this information as well, for example by including a further column in Table 1 indicating the probability distribution to be used for each segment. For example, in the embodiment illustrated in FIGS. 2A-2B, four compensation payouts are available with an equal probability of 0.25 each.

In another embodiment, the probability distribution varies based on the player's tier and the number of times the double wager has been offered ("rounds"). For example, Table 4 illustrates how the player's tier and rounds may be used to obtain an unequal probability distribution:

TABLE 4

| Round # | Tier | FREE DXP 10 Min | FREE DXP 20 Min | FREE Coins 10% | Free Coins 20% | Free Coins 100% | Free Coins 200% | Undo | Buy Back |
|---|---|---|---|---|---|---|---|---|---|
| 1 | Bronze | 15% | 3% | 3% | 3% | 1% | 0% | 25% | 25% |
| 2 | Bronze | 10% | 4% | 3% | 3% | 2% | 1% | 30% | 20% |
| 3 | Bronze | 5% | 5% | 3% | 3% | 2% | 2% | 35% | 15% |
| 1 | Silver | 15% | 3% | 3% | 3% | 1% | 0% | 30% | 20% |
| 2 | Silver | 10% | 4% | 3% | 3% | 2% | 1% | 35% | 15% |
| 3 | Silver | 5% | 5% | 3% | 3% | 2% | 2% | 40% | 10% |

In this example, there are two player tiers, Bronze and Silver, each of which may have up to three rounds of double wagers in a row (after the third round, the cool down period is initiated). There are four compensation payout types shown (free double experience points, free coins back, undo last round, and buy back percentage win), with example possible values for each combination of payout type (e.g. 10 or 20 minutes of free double experience points; 10%, 20%, 100%, or 200% of free coins relative to wager, etc.). For each tier and round combination, there is shown the probability distribution for selecting the payout and its particular values. In practice, there would be additional rows for other combinations for tiers and rounds, as well as additional columns for additional combinations of payouts and values.

For the compensation payouts 228 and 230 in which there are multiple possible values that may be assigned to the outcome, there are other ways of assigning a plurality of different schedules of probabilities which different probabilities to the outcomes depending on the player's segment. For example, Table 5 shows a mapping of different segment IDs to different compensation payouts and schedules of probabilities for the values:

TABLE 5

| Table 5 Segment ID | Compensation Payout | Outcome Values | Schedule of Probabilities for Values |
|---|---|---|---|
| 22 | Free <X> Minutes | X = (10, 20, 30, 40, 50, 60, 120, 240, 480, 720, 1440, 2880) | (0.1, 0.1, 0.1, 0.1, 0.1, 0.1, 0.1, 0.1, 0.1, 0.1) |

TABLE 5-continued

| Table 5 Segment ID | Compensation Payout | Outcome Values | Schedule of Probabilities for Values |
|---|---|---|---|
| 22 | Free <X %> Coins | X = (10%, 20%, 30%, 40%, 50%, 75%, 100%, 200%, 400%> | (.20, .18, .16, .14, .12, .10, .04, .03, .02, .01) |
| 23 | Free <X> Minutes | X = (10, 20, 30, 40, 50, 60, 120, 240, 480, 720, 1440, 2880) | (0.1, 0.2, 0.3, 0.2, 0.05, 0.05, 0.025, 0.025, 0.025, 0.025) |
| 23 | Free <X %> Coins | X = 5%, 10%, 20%, 50%, 60%, 80% 100%, 150%, 200%> | (.05, .10, .10, .20, .20, .10, .05, 0.05, .05, .05, .05) |

The double wager module 128 uses the schedule of probabilities to evaluate a randomly selected number, and then selects the value of the payout based on random number as compared with the schedule. For example, assuming a schedule with an equal distribution of ten possible values, if the double wager module 128 generates a random value of 0.7332, this would map to the eighth value in the schedule.

For the compensation payouts 234 and 244 in which the player makes a payment to obtain the compensation result, the pricing of the compensation payout is a function of attributes of the player's segment. Table 6 shows examples for pricing of the Undo and Get Back Original Win compensation payouts.

TABLE 6

| Tier | Level | Paying? | Undo (244) Price | Buy Back (234) Price | Minimum Credits | Maximum Credits |
|---|---|---|---|---|---|---|
| Diamond | 100 | No | $1 | $1 | 288,000 | 352,000 |
| Diamond | 100 | Yes | $16 | $15 | 4,140,000 | 5,060,000 |
| Diamond | 100 | No | $6 | $6 | 4,140,000 | 5,060,000 |
| Royal Diamond | 100 | No | $1 | $1 | 342,000 | 418,000 |
| Royal Diamond | 100 | Yes | $55 | $45 | 20,700,000 | 25,300,000 |
| Royal Diamond | 50 | No | $1 | $1 | 189,000 | 231,000 |
| Royal Diamond | 50 | Yes | $55 | $45 | 11,250,000 | 13,750,000 |

As shown here, the price for each of the Undo 244 and Buy Back 234 options are priced based upon the player's tier, level and paying status. The minimum credits columns indicates the minimum amount of credits that must be wagered in the double wager to allow for the Undo or Buy Back options, and the maximum credits indicate the maximum amount of credits; the price columns show the real work price (in dollars) that the player must pay to undo the last round or buy back the credits.

For the last compensation payout to unlock a feature of a game or gaming system, the selected feature or features can be any feature that is programmatically accessible, for example by setting parameters in a game or system configuration file.

The logic defining the operations of the compensation payouts as described above is programmatically encoded in the double wager module 128 and/or segmentation service 123, for example, and values and schedule of distributions stored in accessible memory.

Accordingly, the double wager module 128 determines 226 which compensation payout to offer, and the particular values of the payout using the associated probabilities or parameters discussed above, and a random number generator to generate one or more random numbers for evaluating against the probability schedules.

Assume that the double wager module 128 determines in process 226 to offer the player the free coins compensation payout 228. Then the double wager module 128 determines the amount of coins to offer, using for example a mechanism such as Tables 4 or 5. For example, the double wager module 128 may use Table 5, and lookup the schedule of values X and the associated probability schedule, and then generate a random value and compare with the probability schedule to select the corresponding values. For example, if the double wager module 128 used the fourth row of Table 5 (assuming the player's segment ID was 23), and generated a random value of 0.82, then the corresponding value would be 100% since 0.82 falls in the seventh interval of the cumulative probability distribution between 0.80 and 0.85. Once the corresponding value for the percentage of free coins is determined, the double wager module 128 calls the update balance process 212, passing in the player ID and the determined value as parameters. The update balance process 212 accesses the player's amount wagered from the player dynamic properties database 118, applies the percentage to the wager amount, and adds the result to the player's current balance. For example, if the wager was 100,000,000 coins and the percentage was 100%, another 100,000,000 coins would be added to the player's balance. After the balance is updated, the double wager module 128 returns 206 to the primary game.

Similarly, assume that the double wager module 128 determines in process 226 to offer the player the free double experience points offer 230. Then the double wager module 128 determines the number of minutes to offer, using for example a mechanism such as Tables 4 or 5, as just described. For example, if the double wager module 128 used the third row of Table 5 (assuming the player's segment ID was 23), and generated a random value of 0.94, then the corresponding value would be 2,880 minutes (24 hours) since 0.94 falls in the ninth interval of the cumulative probability distribution between 0.9 and 1.00. Once the corresponding value for the number of free minutes is determined, the double wager module 128 displays a screen, such as screen 320, to display the number of free minutes, and calls the activate double experience points process 232, passing in the player ID and the determined number of minutes as parameters. The active process 232 accesses the player dynamic properties database 118 and sets a timer value for the double experience points period equal to the specified value. The double wager module 128 returns 206 to the primary game, at which time the player begins to earn the double experience points.

Assume that the double wager module 128 determines in process 226 to offer the player the buy back compensation payout 234. The double wager module 128 determines the amount of coins to offer for buy back, for example using a table in memory such as Table 6 to lookup the buy back price and amount of coins. The double wager module 128 then displays a screen, such as screen 316, providing the buy back offer 234 to the player. The price in dollars is converted to a price in the game currency; for example in screen 316 the price is shown as "$2,000"; the actual real dollar price may be $1, for example. Table 6 shows real dollar pricing. If the double wager module 128 receives 236 an input accepting the offer, then it begins a purchase flow 238 in which the player selects a payment mechanism (e.g., existing credit or debit card information stored in the player's account). If the payment is not approved, an error message 246 is shown and the player is returned to the buy back offer 234 to try again. If the payment is approved 240, then the double wager module 128 displays 242 a confirmation screen, such as screen 318. The double wager module 128 calls the update balance process 212, passing in the player ID and the purchased number of coins as parameters. The update balance process 212 accesses the player's account from the player dynamic properties database 118 adds the amount to the player's current balance. After the balance is updated, the double wager module 128 returns 206 to the primary game.

Assume that the double wager module 128 determines in process 226 to offer the player the undo compensation payout 244. The double wager module 128 determines the real dollar price for the undo offer, for example using a table in memory such as Table 6 to lookup the undo price. The double wager module 128 then display a screen, such as screen 316, providing the undo offer 244 to the player. For example in screen 322 the price is shown as "$2,000." If the double wager module 128 receives 246 an input accepting the offer, then it begins a purchase flow 248 in which the player selects a payment mechanism. If the payment is not approved, an error message 252 is shown, and the player returned to the undo offer screen 244 to try again. If the payment is approved 250, then the double wager module 128 displays 242 a confirmation screen, such as screen 318, and a call to the update balance process 212 to update the player's balance with the amount of credits that are being restored to the player's account. The double wager module 128 then returns double wager game screen 208, and the number of rounds is incremented.

Figure 4:
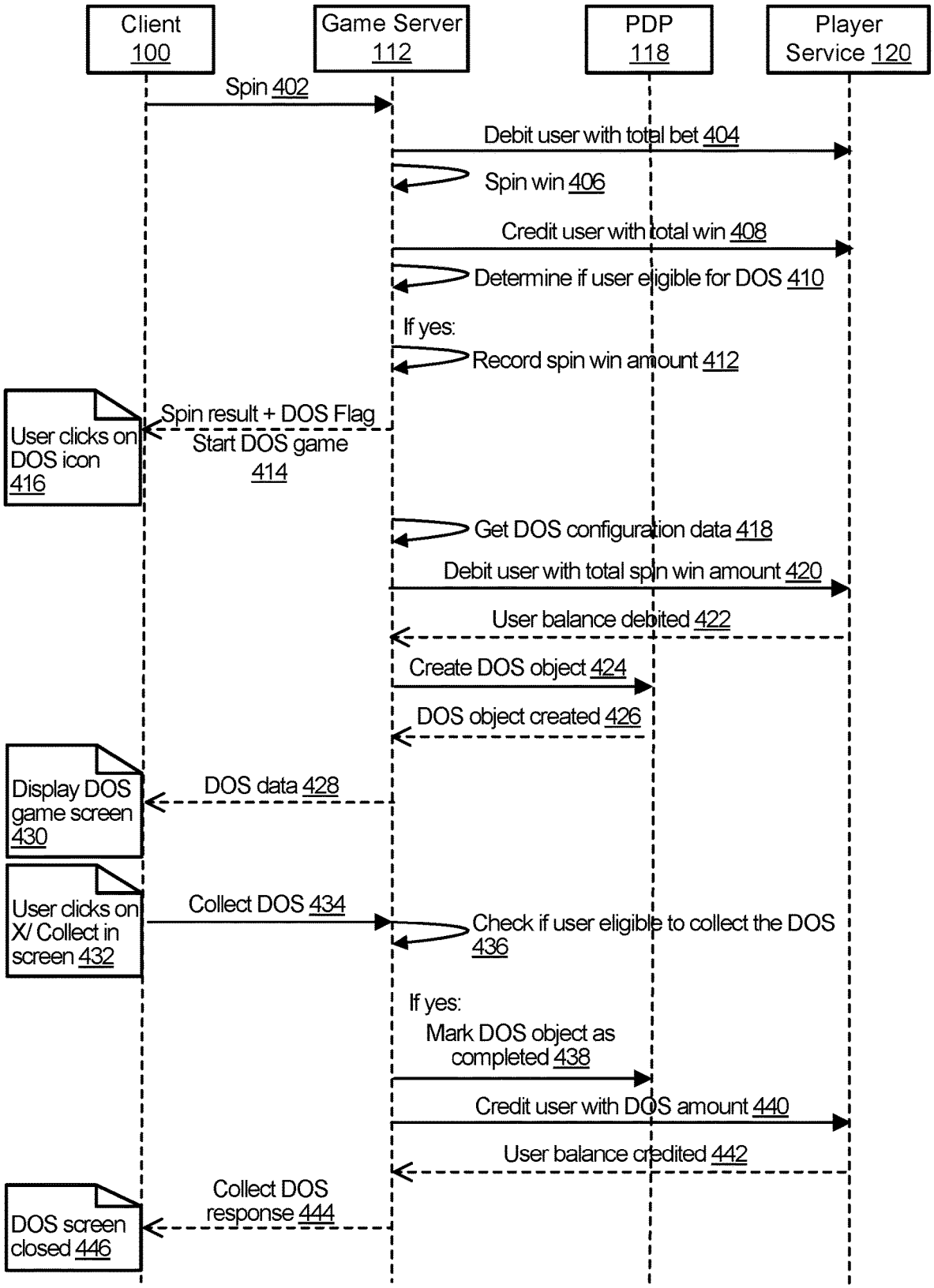
FIG. 4 is an interaction diagram for the general algorithm for the system elements.

FIG. 4 illustrates an interaction diagram for the general algorithm for the system elements in providing the double wager game, according to one embodiment. As shown in FIG. 4, the double wager game includes interactions between the client device 100, the game server 112, the player dynamic properties database 118 (shown in FIG. 4 as "PDP 118"), and the player service 120. In FIG. 4, solid lines represent actions performed by a component, and dotted lines represent responses to the actions. Other embodiments of the double wager game may include different, fewer, or additional steps than those shown in FIG. 4, and the steps may be performed in different orders.

As shown in FIG. 4, the client device 100 sends 402 the game server 112 an action in a primary game, such as a spin, which is associated with a bet amount. The game server 112 debits 404 the bet amount from the player's account via the player service 120, which enables activation of the game logic to determine the outcome of the action. If the action resulted in a win 406, the game server 112 credits 408 the player's account with an amount won via the player service 120.

If the player won 406 the round in the primary game, the game server 112 determines 410 whether the player is eligible to wager the amount won in a double wager game. The game server 112 uses a plurality of eligibility criteria, such as those defined in Table 1, associated with the player's segment to determine 410 whether the player is eligible for the double wager game (abbreviated as "DOS" in FIG. 4), including whether a type of the win 406 satisfies win triggers defined for the player's segment, whether the amount won is greater than a minimum threshold and less than a maximum threshold defined for the player's segment, whether the player has played a maximum number of rounds of the double wager game before resuming the primary game, or whether a cool-down period is in effect. This determination is made by the double wager module 128 in the manner described above.

If the player is determined 410 to be eligible for the double wager game, the game server 112 records 412 the amount won and the type of win in the primary game, for example in a cache internal to the game server 112. The game server 112 sends 414 the result of the round in the primary game (the win 414) and a flag initiating the double wager game, offering the double wager game to the player's client device 100. The client device 100 displays the offer, for example by displaying a screen within the client application 102 with a double wager button. If the player desires to play the double wager game and provides an input to start the game, such as selecting the double wager button, the client device 100 receives 416 the input to start the double wager game.

The game server 112 retrieves 418 configuration information for the double wager game, including a type of bet for the double wager game (e.g., selection of red or black, a roll of a die, or another type of bet) and information for displaying the double wager game at the client device 100. The game server 112 debits 420 the player's account for the amount won in the primary game, via the player service 120. After the player's account has been debited 422, the game server 112 uses the internal cache and the player dynamic properties database 118 to create 424 an object for the double wager game including a double wager token. The double wager token specifies an identifier of the player, an identifier of a type of the primary game, the amount won in the primary game, and any other relevant data from the primary game. The player dynamic properties database 118 returns 426 a response when the double wager response is created.

The game server 112 sends 428 data for the double wager game to the client device 100, which displays 430 a game screen for the double wager game to the player, and enables the game play for the double wager game, as illustrated in FIGS. 2 and 3. After the player plays the double wager game, the client device 100 receives 432 an input from the player to collect any winnings from the double wager game, such as a selection by the player of a "collect" button displayed by the client device 100. The client device 100 sends 434 the game server 112 a request to collect the winnings from the double wager game. The game server 112 determines 436 whether the player is eligible to collect the winnings. For example, the game server 112 determines whether the player's winnings in the double wager game have exceeded a maximum amount defined for the platform type of the client device 100 and the player's segment.

If the player is eligible to collect the winnings, the game server 112 communicates 438 with the player dynamic properties database 118 to mark the double wager object as completed, and communicates 440 with the player service 120 to credit the player's account with any amount won in the double wager game. Once the player's account has been credited 442, the game server 112 returns 444 a response to the client device 100 ending the double wager game, and the client device closes 446 the double wager game.

FIGS. 5A-5D together illustrate a more detailed interaction diagram illustrating an algorithm for the specific interactions for four different types of compensation payouts associated with double wager games. As shown in FIGS. 5A-5D, the compensation payouts comprise interactions between the client device 100, the game server 112, the player dynamic properties database 118, the player service 120, the payment service 116, and the bonus service 114. In FIG. 5, solid lines represent actions performed by a component, and dotted lines represent responses to the actions. Other embodiments of the double wager game may include different, fewer, or additional steps than those shown in FIGS. 5A-5D, and the steps may be performed in different orders.

Figure 5A:
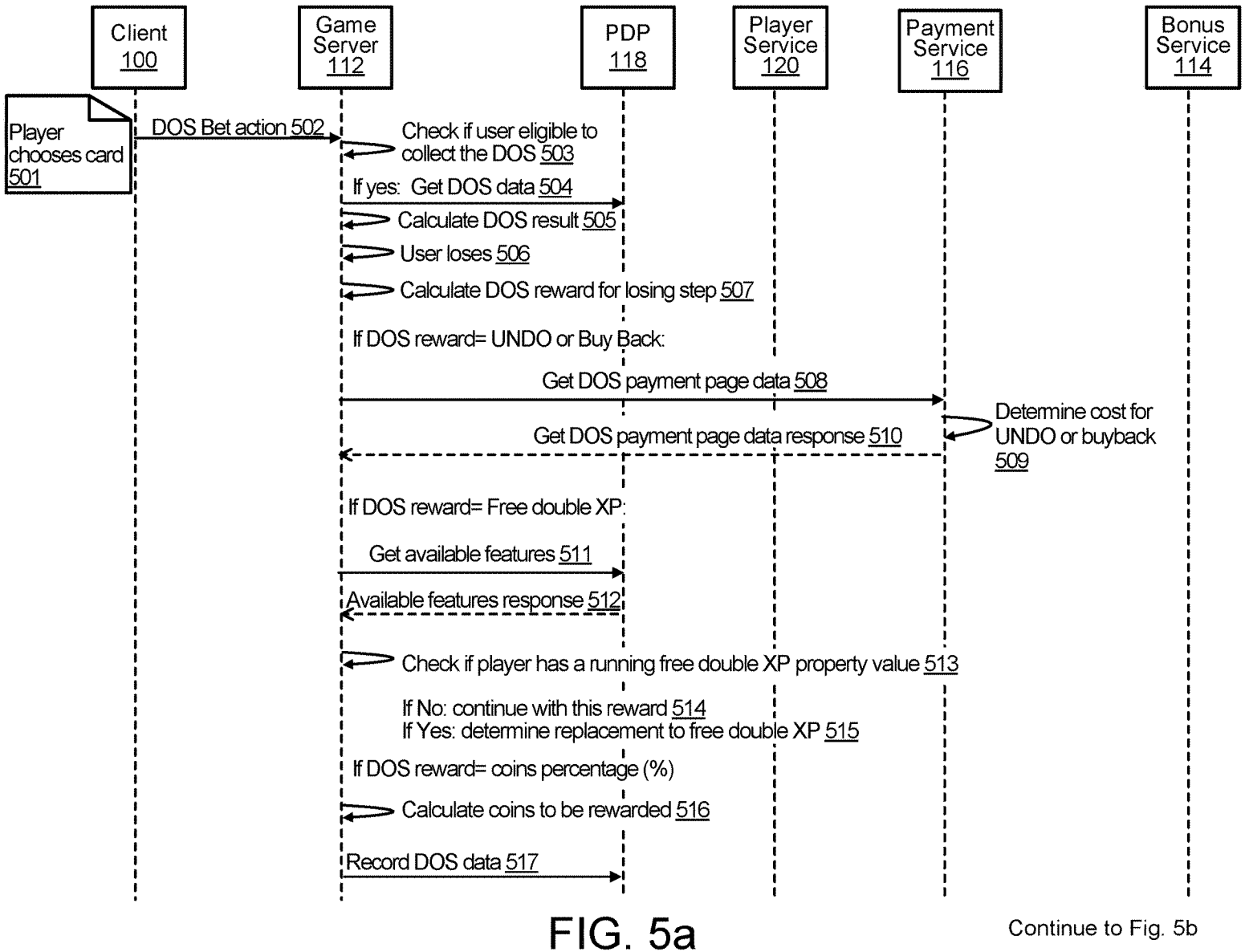
FIGS. 5A-5D together are a more detailed interaction diagram of the system.
Figure 5B:
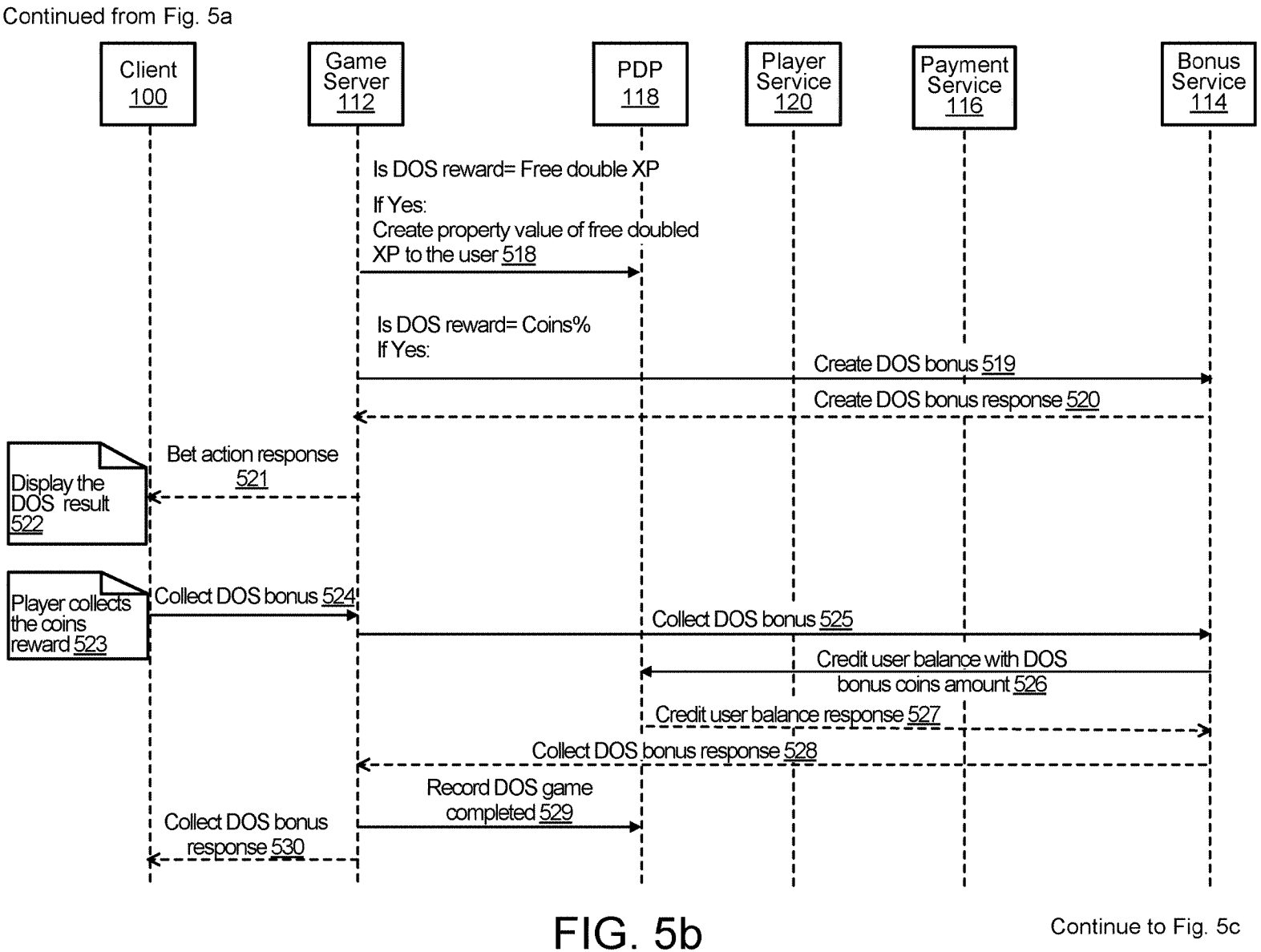
Figure 5C:
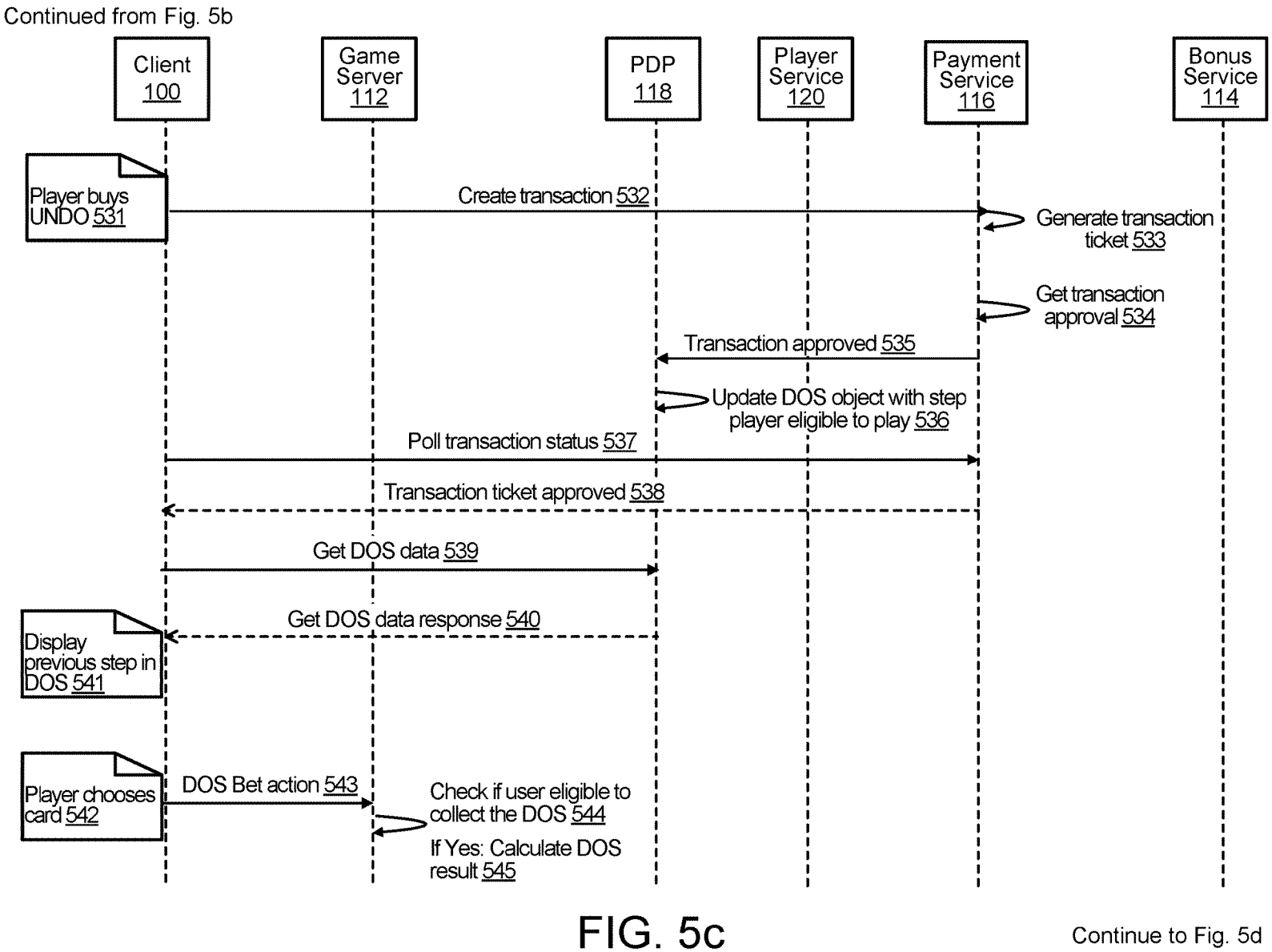
Figure 5D:
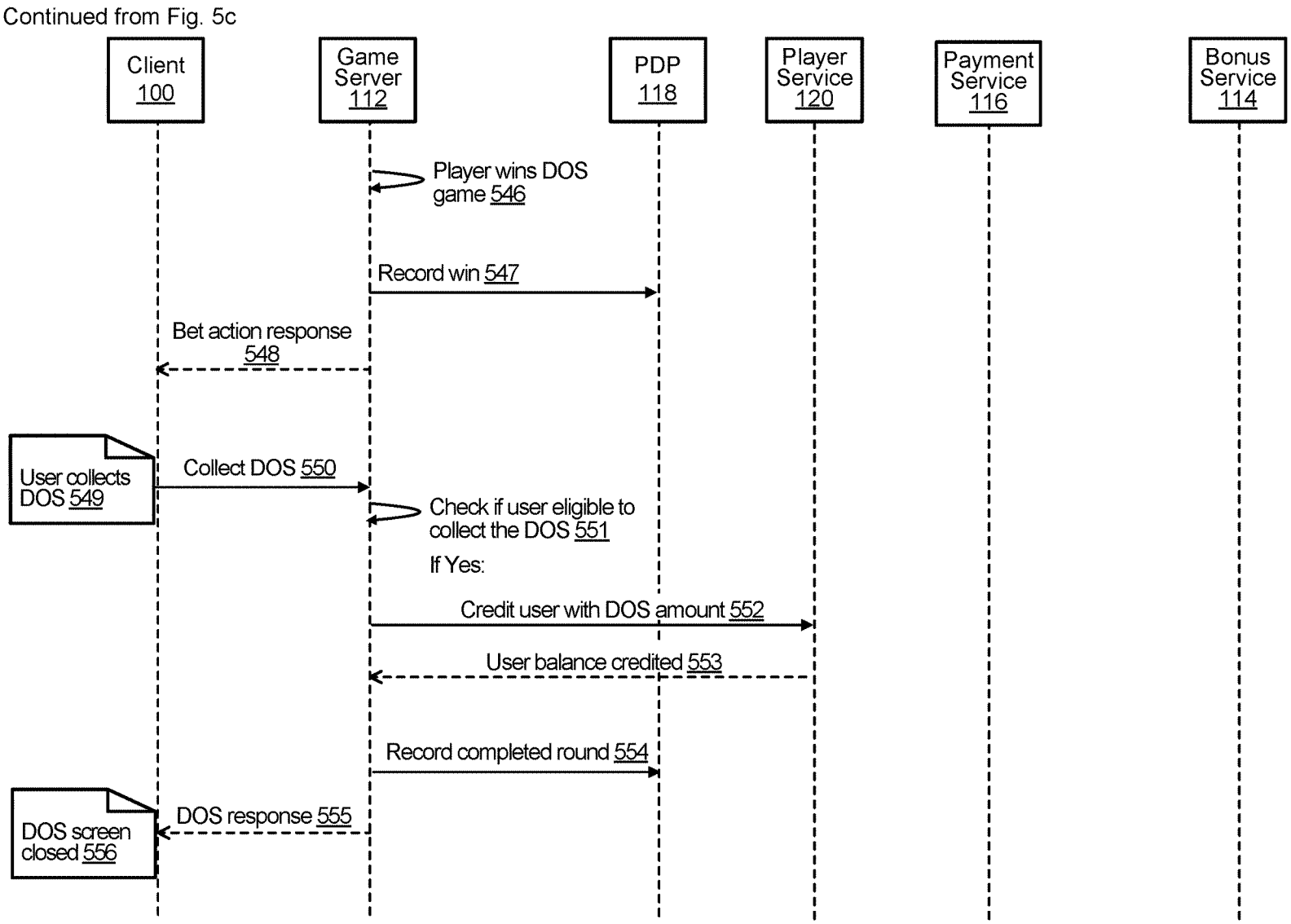

As shown in FIG. 5A, a player selects an option to place a bet in a double wager game using the client device 100. For example, the player selects red or black. The client device 100 receives 501 the player selection and sends 502 the action to the game server 112.

The game server 112 determines 503 whether the player is eligible to collect winnings from a double wager game. As in FIG. 4, the game server 112 uses a plurality of eligibility criteria associated with the segment parameters of the player's segment to determine 503 whether the player is eligible to collect the winnings from the double wager game, including whether a type of win in the primary game satisfies win triggers defined for the player's segment, whether the amount won is greater than a minimum threshold and less than a maximum threshold defined for the player's segment, whether the player has played a maximum number of rounds of the double wager game, or whether a cool-down period is in effect.

If the player is determined 503 to be eligible to receive the double wager compensation based on the segment parameters and criteria, the game server 112 retrieves 504 data for the double wager game from the player dynamic properties database 118 and calculates 505 the result of the double wager game. For example, the game server 112 compares a random number with a defined schedule of ranges mapping the number to an outcome in the double wager game, or traverses a predetermined list of random outcomes.

If, based on the calculation 505, the user is determined to lose 506 the double wager game, the game server 112 calculates 507 a compensation payout for the loss. In one embodiment, the compensation payout for a given loss of the double wager game is probabilistically selected from a plurality of compensation payouts. Equal or different probabilities may be assigned to each of the plurality of compensation payouts, and the game server 112 evaluates a random number against a schedule of the probabilities to select one of the compensation payouts. In the example shown in FIGS. 5A-5D, the compensation payout is selected from an opportunity to pay to undo the double wager round, an opportunity to buy back the credits lost in the double wager, a time period during which experience points are doubled, and a selected percentage of the credits wagered in the double wager round. Other compensation payouts may be offered to a user who loses a double wager game.

If the selected compensation payout is an option to pay to undo the double wager round or to buy back credits lost in the double wager, the game server 112 queries 508 the payment service 116 to get payment page data for the compensation payouts. The payment service 116 determines 509 the amount for the player to pay to undo the round or to buy back the lost credits, for example by querying a table similar to Table 6, which specifies pricing for the undo and buyback options based on factors such as the player's segment. The payment service 116 returns 510 the payment page data to the game server 112.

If the selected compensation payout includes doubled experience points for a period of time, the game server 112 queries 511 the player dynamic properties database 118 for features of the double wager game that are available for the double experience points, and the player dynamic properties database 118 returns 512 the features to the game server 112. The game server 112 checks 513 whether the player has an active double experience points property value. If not, the game server 112 continues 514 with providing the double experience points. If there is an active double experience points property value, the game server 112 determines 515 a replacement compensation payout for the player.

If the selected compensation payout is a selected percentage of the credits wagered in the double wager round, the game server 112 calculates 516 the credits to be awarded to the player. In one embodiment, the game server 112 calculates 516 the credits by querying a table such as Table 4 or Table 5 for the percentage to be awarded. For example, the game server 112 generates a random number using a pseudorandom number generator, and compares that number against the probability schedule shown in Table 5. The game server 112 then multiplies the determined percentage by the credits wagered in the double wager round to determine the credits to be awarded in the compensation payout.

The game server 112 records 517 information about the double wager game in the player dynamic properties database 118, including the step of the double wager game lost by the player, the bet placed by the player in the double wager game, and the compensation payout selected for the loss. If the selected compensation payout is double experience points, the game server 112 creates 518 (FIG. 5*b*) a property value in the player dynamic properties database 118 indicating the doubled experience points. On the other hand, if the selected compensation payout is a percentage of wagered coins returned, the game server 112 communicates 519 with the bonus service 114 to create the bonus coins, which returns 520 a response to the game server 112 when completed.

The game server 112 returns 521 a response to the client device 100 for the player's bet action in the double wager game, indicating that the player lost the double wager and offering the selected compensation payout. The client device 100 displays 522 the losing result and the selected compensation payout, and the player may then use the client device 100 to collect the selected compensation payout, if desired.

For example, in the case that the compensation payout is a percentage of wagered coins, the player provides an input at the client device 100, such as selection of a "collect" button. The client device 100 receives 523 the player input, and notifies 524 the game server 112 of the collection of the coins. The game server 112 in turn notifies 525 the bonus service 114 of the collection, which credits 526 the player's account balance in the player dynamic properties database 118 with the bonus coin amount. Once the player's account has been credited, the database 118 returns 527 a response to the bonus service 114, and the bonus service 114 returns 528 a response to the game server 112. The game server 112 records 529, at the player dynamic properties database 118, the completion of the double wager game, and returns 530 a response to the client device 100 indicating the completion of the bonus coin collection.

In the case that the selected compensation payout is an option to pay to undo the result of the double wager round, the player provides an input at the client device 100 if the player desires to purchase the undo option. The client device 100 receives 531 (FIG. 5*c*) the player input, and communicates with the payment service 116 to create 532 a transaction. The payment service 116 generates 533 a transaction ticket for purchasing the undo option and creates a transaction in the database. The transaction ticket comprises unique number indicating specific payment for the undo option, and enables the game server 112 to track the specific payment. The payment service 116 receives 534 an "approve" response for the transaction once the ticket has been created, and notifies 535 the player dynamic properties database 118 that the transaction to purchase the undo option was approved. The player dynamic properties database 118 updates 536 the double wager object for the player with the step of the double wager round the player is eligible to play again, after purchasing the undo option.

The client device 100 polls 537 the payment service 116 for the status of the transaction, and the payment service 116 returns 538 a notification when the transaction ticket has been approved. The player may then use the client device 100 to play the last round of the double wager game again. To execute the last round, the client device 100 retrieves 539 configuration information for the double wager round from the player dynamic properties database 118, such as the type of bet to be placed by the player (e.g., selecting a card). The database 118 returns 540 the information to the client device 100, which displays 541 the round of the game to the player.

As the player plays the double wager game after undoing the last round of the game, the player places a wager (e.g., selects a card). The client device 100 receives 542 the player's wager, and sends 543 the wager to the game server 112. Similar to step 503, the game server 112 determines 544 whether the player is eligible to collect winnings from the double wager game, and calculates 545 the result of the game if the player is eligible.

If the player wins 546 (FIG. 5*d*) the double wager round, the game server 112 records 547 in the player dynamic properties database 118 the round won, the player's winning wager, and the completion of the "undo" action. The game server 112 also returns 548 a response to the client device 100, indicating the player's win.

The player can then interact with the client device 100 to collect the winnings from the double wager game. The client device 100 receives 549 the player's input, and notifies 550 the game server 112 of the player's collection. The game server 112 checks 551 whether the player is eligible to collect the double wager winnings, by, for example, determining whether the player's winnings in the double wager game have exceeded a maximum amount defined for the platform type of the client device 100 and the player's segment. If the player is eligible, the game server 112 communicates 552 with the player service 120 to credit the player with the amount won in the double wager game. The player service 120 returns 53 a response indicating the credit, and the game server 112 records 554 in the player dynamic properties database 118 the completed round of the double wager game, and marks the double wager game as completed. The game server 112 sends 555 a response to the client device 100, which closes 556 the double wager game.

Within this written description, the particular naming of the components, capitalization of terms, the attributes, data structures, or any other programming or structural aspect is not mandatory or significant unless otherwise noted, and the mechanisms that implement the described invention or its features may have different names, formats, or protocols.

The various embodiments include an apparatus for performing the operations herein. This apparatus may be specially constructed for the required purposes, or a computer selectively activated or reconfigured by a computer program stored in the computer. Such a computer program may be stored in a non-transitory computer readable storage medium, such as, but is not limited to, any type of disk including floppy disks, optical disks, DVDs, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention.

What is claimed is:

1. A method of operating an online gaming system, comprising:

receiving, by a payment service from a client device, one or more credits from an account of a player as a wager to activate a primary game;

determining, by a double wager module of the online gaming system, that the player has won an amount of credits in the primary game based on the wager;

determining, by the double wager module and utilizing a segmentation service and a database, whether the player is eligible to wager the amount of credits won in a double wager game, based on a plurality of eligibility requirements associated with a segment for the player, wherein the segmentation service comprises programmed logic to create and manage player segments and determines a player's segment based at least in part on a parameter indicating at least one of a software platform of the client device and based at least in part on historical levels of investment and game play, wherein the segmentation service returns an indication of whether the double wager game with compensation payouts is available and wherein the segmentation service returns a schedule for selecting a compensation payout to offer the player, wherein determining whether the player is eligible comprises limiting at least one of a web client to a first wager threshold and a mobile device platform to a second wager threshold lower than the first wager threshold based on the parameter indicating a software platform;

responsive to determining by the segmentation service that the player is eligible to wager the amount of credits won in the primary game, offering, by a game server, the double wager game to the player via a client device of the player, wherein the double wager game provides a fair or better bet to double the amount of credits won in the primary game, and receiving a player's acceptance of the double wager via an interaction of the client device with the online gaming system;

determining, by a game server, whether the player has won or lost the double wager;

responsive to a game server, determining that the player has lost the double wager game:

selecting, by a game server having a double wager module, from a plurality of different types of compensation payouts a compensation payout to offer to the player via the client device;

determining, by the game server having a double wager module, parameters of the selected compensation payout based at least in part on the segment for the player, the parameters including an amount of the compensation, wherein the selected compensation payout is selected from the plurality of types of compensation payouts according to a probability distribution defining a probability for selecting each of the types of compensation payouts, and wherein selecting the compensation payout comprises generating a random number using a random number generator and comparing the generated random number against the probability distribution to determine programmatically the selected compensation payout; and providing, from the game server to a client, the amount of compensation, wherein an eligibility requirement of the plurality of eligibility requirements specifies a minimum threshold and a maximum threshold for the amount won in the primary game, and wherein determining by the double wager module whether the player is eligible to wager the amount won in a double wager game comprises:

determining by the online gaming system whether the amount won in the primary game is greater than the minimum threshold and less than the maximum threshold; and responsive to the amount won in the primary game being greater than the minimum threshold and less than the maximum threshold, offering by the game server the double wager game to the player.

2. The method of claim 1, wherein determining by the online gaming system whether the amount won in the primary game is greater than the minimum threshold and less than the maximum threshold comprises:

storing by the online gaming system a table defining minimum and maximum thresholds for each of a plurality of marketing segments; and comparing by the online gaming system the amount won in the primary game to the minimum and maximum thresholds defined in the table for the segment for the player.

3. The method of claim 1, wherein an eligibility requirement of the plurality of eligibility requirements specifies a maximum number of times the player can wager an amount in the double wager game before resuming the primary game, and wherein determining by the online gaming system whether the player is eligible to wager the amount won in a double wager game comprises:

determining by the online gaming system a number of double wager games played by the player after winning the amount in the primary game; and responsive to the number of double wager games played being less than the maximum number of times, offering by the online gaming system the double wager game to the player.

4. The method of claim 1 wherein a different probability distribution for the plurality of types of compensation payouts is defined for each of a plurality of different player segments, and wherein selecting the compensation payout comprises:

determining by the online gaming system the probability distribution of the plurality of types of compensation payouts based on the segment for the player.

5. The method of claim 1, wherein the parameters of the selected compensation payout are determined according to a schedule of probabilities mapping each of a plurality of parameters associated with the selected compensation payout to a probability for selecting each parameter.

6. A method of operating an online gaming system, comprising:

receiving, by a payment service from a client, one or more credits from an account of a player as a wager to activate a primary game;

determining, by a double wager module of the online gaming system, that the player has won an amount of credits in the primary game based on the wager;

determining, by the double wager module and utilizing a segmentation service and at least one of a database and a lookup table, whether the player is eligible to wager the amount of credits won in a double wager game, based on a plurality of eligibility requirements associated with a marketing segment for the player, wherein the segmentation service comprises programmed logic to create and manage player segments and determines a player's segment based at least in part on a parameter indicating at least one of a software platform of the client device and based at least in part on historical levels of investment and game play, wherein the segmentation service returns an indication of whether the double wager game with compensation payouts is available and wherein the segmentation service returns a schedule for selecting a compensation payout to offer the player, wherein determining whether the player is eligible comprises limiting at least one of a web client to a first wager threshold and a mobile device platform to a second wager threshold lower than the first wager threshold based on the parameter indicating a software platform;

responsive to determining by the segmentation service that the player is eligible to wager the amount of credits won in the primary game, offering, by a game server, the double wager game to the player via a client device of the player, wherein the double wager game provides a fair or better bet to double the amount of credits won in the primary game, and receiving a player's acceptance of the double wager via an interaction of the client device with the online gaming system;

determining, by a game server, whether the player has won or lost the double wager;

responsive to a game server, determining that the player has lost the double wager game:

selecting, by a game server having a double wager module, from a plurality of different types of compensation payouts a compensation payout to offer to the player via the client device;

determining, by the game server having a double wager module, parameters of the selected compensation payout based at least in part on the segment for the player, the parameters including an amount of the compensation, wherein the selected compensation payout is selected from the plurality of types of compensation payouts according to a probability distribution defining a probability for selecting each of the types of compensation payouts, and wherein selecting the compensation payout comprises generating a random number using a random number generator and comparing the generated random number against the probability distribution to determine programmatically the selected compensation payout; and providing, from the game server to a client, the amount of compensation, wherein the parameters of the selected compensation payout further comprise an amount for the player to pay to collected the selected compensation payout, and wherein determining, by the game server having a double wager module, the parameters of the selected compensation payout further comprises determining by the segmentation service the amount for the player to pay based on the marketing segment for the player.

7. A method of operating an online gaming system, comprising:

receiving, by a payment service from a client, one or more credits from an account of a player as a wager to activate a primary game;

determining, by a double wager module of the online gaming system, that the player has won an amount of credits in the primary game based on the wager;

determining, by the double wager module and utilizing a segmentation service and at least one of a database and a lookup table, whether the player is eligible to wager the amount of credits won in a double wager game, based on a plurality of eligibility requirements associated with a marketing segment for the player, wherein the segmentation service comprises programmed logic to create and manage player segments and determines a player's segment based at least in part on a parameter indicating at least one of a software platform of the client device and based at least in part on historical levels of investment and game play, wherein the segmentation service returns an indication of whether the double wager game with compensation payouts is available and wherein the segmentation service returns a schedule for selecting a compensation payout to offer the player, wherein determining whether the player is eligible comprises limiting at least one of a web client to a first wager threshold and a mobile device platform to a second wager threshold lower than the first wager threshold based on the parameter indicating a software platform;

responsive to determining by the segmentation service that the player is eligible to wager the amount of credits won in the primary game, offering, by a game server, the double wager game to the player via a client device of the player, wherein the double wager game provides a fair or better bet to double the amount of credits won in the primary game, and receiving a player's acceptance of the double wager via an interaction of the client device with the online gaming system;

determining, by a game server, whether the player has won or lost the double wager;

responsive to a game server, determining that the player has lost the double wager game:

selecting, by a game server having a double wager module, from a plurality of different types of compensation payouts a compensation payout to offer to the player via the client device;

determining, by the game server having a double wager module, parameters of the selected compensation payout based at least in part on the segment for the player, the parameters including an amount of the compensation, wherein the selected compensation payout is selected from the plurality of types of compensation payouts according to a probability distribution defining a probability for selecting each of the types of compensation payouts, and wherein selecting the compensation payout comprises generating a random number using a random number generator and comparing the generated random number against the probability distribution to determine programmatically the selected compensation payout; and providing, from the game server to a client, the amount of compensation, wherein the plurality of types of compensation payouts comprise an amount of time during which experience points in the primary game are doubled, a percentage of credits wagered and lost in the double wager game, a payment of a calculated amount of credits to receive the amount of credits won in the primary game, and a payment of a calculated amount of credits to undo a result of the double wager game.

8. A non-transitory computer-readable storage medium storing executable instructions, the instructions when executed by a processor causing the processor to:

receive, by a payment service, one or more credits from a player account as a wager to activate a primary game;

determine, by a double wager module of the online gaming system, that the player has won an amount of credits in the primary game based on the wager;

determine by the double wager module and utilizing a segmentation service and at least one of a database and a lookup table, whether the player is eligible to wager the amount of credits won in a double wager game, based on a plurality of eligibility requirements associated with a marketing segment for the player, wherein the segmentation service comprises programmed logic to create and manage player segments and determines a player's segment based at least in part on a parameter indicating at least one of a software platform of the client device and based on historical levels of investment and game play, wherein the segmentation service returns an indication of whether the double wager game with compensation payouts is available and wherein the segmentation service returns a schedule for selecting a compensation payout to offer the player, wherein determining whether the player is eligible comprises limiting at least one of a web client to a first wager threshold and a mobile device platform to a second wager threshold lower than the first wager threshold based on the parameter indicating a software platform;

responsive to determining by the segmentation service that the player is eligible to wager the amount of credits won in the double wager game, offer, by a game server, the double wager game to the player via a client device of the player, wherein the double wager game provides a fair or better bet to double the amount of credits won, and receiving a player's acceptance of the double wager via an interaction of the client device with the online gaming system;

determine by the online gaming system whether the player has won or lost the double wager game;

responsive to a game server, determining that the player has lost the double wager game:

select by the online gaming system from a plurality of different types of compensation payouts a compensation payout to offer to the player via the client device;

determine by a game server parameters of the selected compensation payout, the parameters based on the selected type of compensation payout based at least in part on the segment for the player, the parameters including an amount of the selected compensation payout, wherein the selected compensation payout is selected from the plurality of types of compensation payouts according to a probability distribution defining a probability for selecting each of the types of compensation payouts, and wherein selecting the compensation payout comprises generating a random number using a random number generator and comparing the generated random number against the probability distribution to determine programmatically the selected compensation payout;

provide, from the game server to a client, the amount of the selected compensation payout, wherein an eligibility requirement of the plurality of eligibility requirements specifies a minimum threshold and a maximum threshold for the amount won in the primary game, and wherein determining by the online gaming system whether the player is eligible to wager the amount won in a double wager game comprises:

determining by the online gaming system whether the amount won in the primary game is greater than the minimum threshold and less than the maximum threshold; and responsive to the amount won in the primary game being greater than the minimum threshold and less than the maximum threshold, offering by the online gaming system the double wager game to the player.

9. The non-transitory computer-readable storage medium of claim 8, wherein an eligibility requirement of the plurality of eligibility requirements specifies a maximum number of times the player can wager an amount in the double wager game before resuming the primary game, and wherein determining by the online gaming system whether the player is eligible to wager the amount won in a double wager game comprises:

determining by the online gaming system a number of double wager games played by the player after winning the amount in the primary game; and responsive to the number of double wager games played being less than the maximum number of times, offering by the online gaming system the double wager game to the player.

10. The non-transitory computer-readable storage medium of claim 9, wherein a different probability distribution for the plurality of types of compensation payouts is defined for each of a plurality of different player segments, and wherein selecting the compensation payout comprises:

determining by the online gaming system the probability distribution of the plurality of types of compensation payouts based on the segment for the player.

* * * * *